United States Patent [19]

Sladkoshteev et al.

[11] 4,186,791

[45] Feb. 5, 1980

[54] PROCESS AND APPARATUS FOR HORIZONTAL CONTINUOUS CASTING OF METAL

[75] Inventors: Vladimir T. Sladkoshteev; Oleg A. Shatagin; Samuil F. Khalemsky; Eleonora B. Besedina, all of Kharkov, U.S.S.R.

[73] Assignees: Ukrainsky Nauchno, Kharkov; Nauchno Proizvodstvennoe, Tula, both of U.S.S.R.

[21] Appl. No.: 754,681

[22] Filed: Dec. 27, 1976

[51] Int. Cl.[2] ..... B22D 11/10

[52] U.S. Cl. ..... 164/66; 164/82; 164/134; 164/259; 164/335; 164/415; 266/218; 266/229

[58] Field of Search ..... 164/66, 259, 335, 133, 164/134, 82, 281 H, 440, 415, 441; 266/218, 220, 227, 229, 231

[56] References Cited

U.S. PATENT DOCUMENTS

| | | | |
|---|---|---|---|
| 2,821,472 | 1/1958 | Peterson et al. | 164/415 X |
| 3,467,284 | 9/1969 | Koncsics et al. | 164/259 UX |
| 3,490,897 | 1/1970 | Dore et al. | 266/218 X |
| 3,517,725 | 6/1970 | Watts | 164/281 H X |
| 3,689,048 | 9/1972 | Foulard et al. | 164/66 X |
| 3,952,928 | 4/1976 | Gerding et al. | 164/133 X |
| 3,998,261 | 12/1976 | Barker | 164/66 |
| 4,064,925 | 12/1977 | Fastner et al. | 164/259 X |

FOREIGN PATENT DOCUMENTS

| | | | |
|---|---|---|---|
| 915381 | 11/1972 | Canada | 164/440 |

*Primary Examiner*—Mark Rosenbaum

*Attorney, Agent, or Firm*—Lackenbach, Lilling & Siegel

[57] ABSTRACT

The process includes the delivery of molten metal for solidification in stepped flow and the blowing of a gas through the flow at a step located at the level of the surface of that portion of the flow which is directly fed for solidification, or at a level exceeding said level by as much as 300 mm.

The apparatus for realizing said process comprises a tundish with a stepped bottom. A means for blowing the gas through the flow of metal is provided within that portion of the tundish which is located level with the upper generatrix of the outlet from the tundish or preferably, at a level about 300 mm above said generatrix.

6 Claims, 2 Drawing Figures

PROCESS AND APPARATUS FOR HORIZONTAL CONTINUOUS CASTING OF METAL

BACKGROUND OF THE INVENTION

The present invention relates to casting processes and preferably to horizontal continuous casting of metal and to apparatus for realizing same. It is most advantageous for use in casting steel of various grades.

DESCRIPTION OF THE PRIOR ART

Widely known in the art at present are processes for continuous casting of metal and apparatus for realizing same, each of said apparatus incorporating a tundish linked up with a mold which may be arranged in horizontal, vertical or inclined positions.

Tundishes used in apparatus for horizontal continuous casting of metal are given the form of containers with an open top, a bottom, side walls and an outlet opening placing in communication the interior of the tundish with the interior of the mold. The tundish is provided with at least one orifice for blowing gas through the flow of molten metal.

It is generally known that in order to improve the quality of the metal poured into the mold, an inert gas, for example argon, should be blown through the flow of molten metal so as to remove air bubbles and nonmetallic particles therefrom. In the known apparatus, the process of degassing and removing nonmetallic particles from the metal by blowing through same an inert gas, or any other gas which does not react with the metal cast, takes place, for example, in the casting ladle. Exposed to the action of the gas can be either the metal contained in a vessel or that which is flowing through a conduit or in the tundish. Yet, in the process of continuous casting of metal wherein a tundish and a mold are arranged horizontally and blowing is effected at a level below the outlet of the tundish, considerable amounts of the inert gas being blown and of the nonmetallic particles are entrained by the flow of the metal, with the result that the quality of the ingot is impaired. The quality of the cast metal is marred by the effect of the cavities, formed therein because of the included gas and/or air, the surfaces of which are subjected to oxidation and around which concentrate nonmetallic particles. During subsequent processing of the solidified cast ingots, the cavities therein are rolled out to cause interior defects giving rise to so-called pinholes.

In addition, the flow of molten metal discharged into the tundish causes turbulence which directs nonmetallic particles to the upper part of the cast metal. The resultant non-uniform distribution of the non-metallic particles causes deletirious effects on the subsequent quality of the produced articles which are susceptible to rapid wear due to the fact that nonmetallic particles are prone to higher stress concentration.

Considerable headway made by engineering poses the problem of constantly improving the quality of the metal, but in solving said problem considerable difficulties are experienced, preventing the possibility of improving the effectiveness of the degassing of metal and the removal of nonmetallic particles from same in the known apparatus and by employing the known methods.

SUMMARY OF THE INVENTION

The primary object of the present invention is to provide a process for horizontal continuous casting of metal and an apparatus for realizing same which will improve the quality of the metal in the ingot cast.

Another important object of the present invention is to prevent the ingress of air bubbles and of the gas blown through the flow of molten metal into the ingot solidifying in the mold.

A further object of the present invention is to increase the effectiveness of the process of removing from the metal gas and nonmetallic particles.

These and other objects are accomplished by a process for horizontal continuous casting of metal which includes the delivery of molten metal in a flow and the blowing of a gas through the flow. The molten metal is fed, according to the invention, in a stepped flow and the gas is blown througn said flow at a step located at the level of the surface of that portion of the flow which is directly fed for solidification or at a level exceeding said level by as much as 300 mm.

The blowing of gas through the flow of molten metal in the manner described above prevents nonmetallic particles, air and the gas blown from entering the ingot being formed and is consequently conducive to improving the quality of the ingot being cast.

It is preferred that the gas be blown through the flow of molten metal from below said step. This way of blowing is more simple and is conducive to better results.

It is preferable to isolate that portion of the flow of molten metal which is blown through with the gas from the zone wherein the metal is discharged into the tundish to a depth at which the turbulence is smoothed down. This prevents any slag from entering the zone where the gas is being blown through the flow of molten metal in the tundish.

It is also preferable to isolate that portion of the flow of molten metal which is being blown through with the gas from the zone from which the metal is being directly fed for solidification to a depth at which turbulence is smoothed down. This isolation of the portion of the flow of molten metal being blown through creates the most favorable conditions for the refining of metal in the zone contiguous to the mold.

Said object is attained in an apparatus for horizontal continuous casting of metal, comprising a tundish with a bottom, at least one orifice for blowing gas through a flow of molten metal, and an outlet opening communicating with an inlet opening of a mold. The bottom of the tundish is, according to the invention, stepped, the orifices for blowing the gas through the flow of molten metal being arranged in the portion of the tundish which has the step and being disposed at the level of the upper generatrix of the outlet opening in the tundish or, preferably, at a level about 300 mm above said generatrix.

Said apparatus allows stepwise delivery of the flow of metal and arrangement of the portion blown through with the gas above the outlet opening in the tundish so as to eliminate the ingress of air and nonmetallic particles into the cast ingot. This will reduce the amount of nonmetallic and gaseous admixtures present in the ingot being cast and consequently improve the quality of same.

It is expedient that the orifices for blowing the gas through the flow of molten metal be arranged in said step of the tundish. This will assure the most effective way of blowing through the flow of molten metal combined with a relatively simple design of the apparatus.

It is expedient that the apparatus of the invention be provided with a vertical transverse partition extending short of the step of the tundish to a depth where turbulence is smoothed down. This partition separates the zone of feeding the metal into the tundish from the zone of blowing through the metal. Said partition keeps away slag and considerably reduces the amount of nonmetallic particles and air entering the zone wherein the liquid metal is blown through.

It is also expedient that such apparatus be provided with a vertical transverse partition extending short of the step of the tundish to a depth where turbulence is smoothed down. This partition separates the zone of blowing through the metal from the zone wherein the metal being discharged into the mold is allowed to settle. Said partition creates the most favorable conditions for both the blowing of the gas through the metal and the settling of the metal preparatory to entering the mold.

BRIEF DESCRIPTION OF THE DRAWINGS

The present invention, both as to its construction and mode of operation, will be best understood from the following description of specific embodiments thereof, when read in conjunction with the accompanying drawings, in which.

DETAILED DESCRIPTION OF THE INVENTION

The herein proposed process for horizontal continuous casting of metal contemplates the delivery of molten metal in a stepped flow and the blowing of a gas through said flow of molten metal at a level, i.e., step, corresponding to the level of the surface of that portion of the flow which is directly fed for solidification or at a level preferably about 300 mm above said surface level.

The gas blown through the flow of molten metal is introduced into the flow either from a side or from below. An inert gas or any other gas which does not react with the metal can be used for the blowing procedure. The fact that the gas is blown through the metal at said level prevents the ingress of air or gas into the ingot.

As the metal is fed in a stream and the gas is blown through same, turbulence is induced in the flow of metal which may cause slag to get entrained in the metal and prevent air bubbles and nonmetallic particles from rising to the surface of the liquid metal. Therefore, in carrying out the process in accordance with the invention, there is provided a partial separation of the portion of the molten metal flow being blown through with the gas from the zone wherein the flow of metal discharges into the tundish at a depth where turbulence is smoothed down.

To enhance the effectiveness of the process of removing from the metal gas and nonmetallic particles, the portion of the molten metal flow being blown through with the gas is also isolated at a depth where turbulence is smoothed down from the zone from which the metal is directly fed for solidification. This results in a considerable improvement of the quality of the cast ingot.

The method described above can be realized by an apparatus according to the invention described hereinafter.

Figure 1:
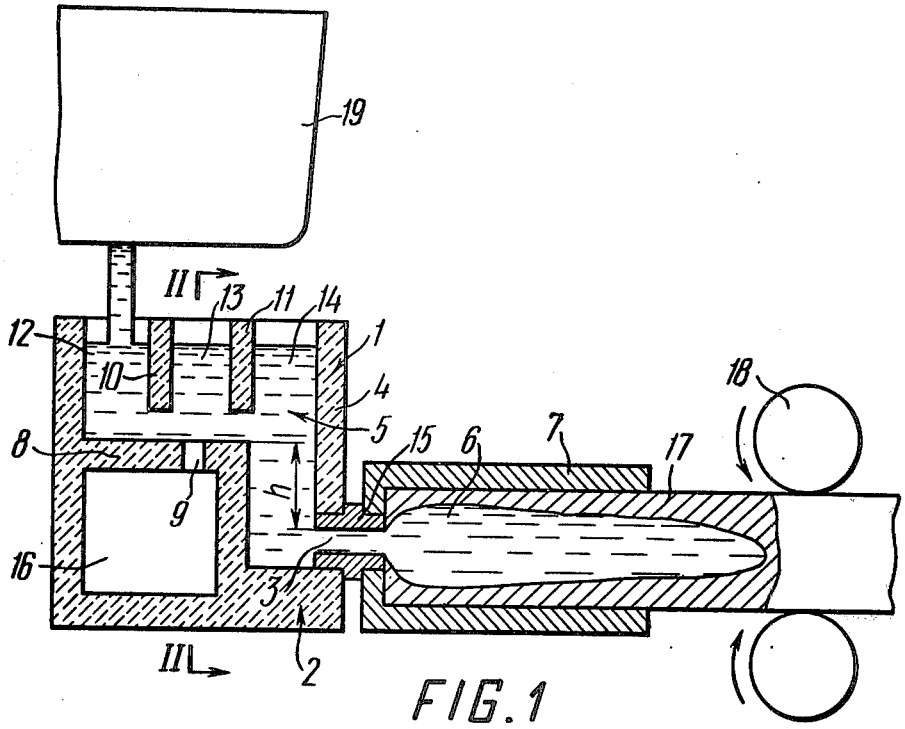
FIG. 1 is a cross sectional, elevational view of a ladle, the apparatus according to the invention and a mold with an ingot being cast.

An apparatus for horizontal continuous casting of metal comprises a tundish 1 (FIG. 1) with a bottom 2 stepped relative to and outlet opening 3 provided in a side wall 4. The opening 3 places in communication an interior 5 of the tundish 1 with an interior 6 of a mold 7. A step 8 of the bottom 2 of the tundish 1 has at least one orifice 9 (FIG. 2) for blowing an inert gas through a flow of molten metal fed into the mold 7 (FIG. 1). Said step 8 can be made at a level h of the upper generatrix of the outlet 3 in the side wall 4 of the tundish 1 or, preferably at a level that exceeds said level by about 300 mm.

In another embodiment of the apparatus, the orifice for blowing a gas (not shown in the drawings) through the flow of molten metal is made in a side wall of the tundish.

The interior 5 of the tundish 1 is divided by two vertical transverse partitions 10 and 11 into a zone 12 from which a stream of molten metal is fed into the tundish 1, a zone 13 in which the inert gas is blown through the portion of the flow above the upper step 8, and a zone 14 for the settling of metal which is in direct proximity with the side wall 4 in which the outlet opening 3 is provided. The interior 5 of the tundish 1 communicates with the interior 6 of the mould 7 by means of a conduit 15. Said partitions 10 and 11 extend between 100 and 200 mm short of the bottom 2 of the tundish 1, this depth being sufficient to smooth down turbulence.

If the step 8 in the bottom 2 of the tundish 1 is provided with more than one orifice 9 for blowing the gas through the metal, a chamber 16 for the gas is provided which communicates with the interior 5 of the tundish 1 through said orifices 9. For withdrawing an ingot 17 from the mold 7 there are provided pinch rolls 18. Molten metal is fed into the tundish 1 by means of a casting ladle 19.

The apparatus according to the invention operates according to the following principles.

Molten metal contained in the casting ladle 19 is fed into the zone 12 of the tundish 1 separated from the zone 13 of blowing the gas through the metal by the partition 10. Since the kinetic energy of the stream of metal from the ladle 19 is high, the flow of molten metal in the zone 12 has a turbulent pattern. This pattern is smoothed down to a considerable extent by the partition 10 so that in the next zones 13 and 14 the flow is a laminar one.

Furthermore, since the bottom 2 of the tundish 1 is made stepped relative to the outlet opening 3, the depth of the flow of molten metal is not the same at all points. Said depth is at its maximum in the zone 14 from which metal is being fed directly from the tundish 1 into the mold 7, whereas the minimum depth is found above the step 8 in the zone 13 where the gas is blown through the flow of liquid metal, this feature being conducive to an enhanced effectiveness of the blowing-through of the metal.

Figure 2:
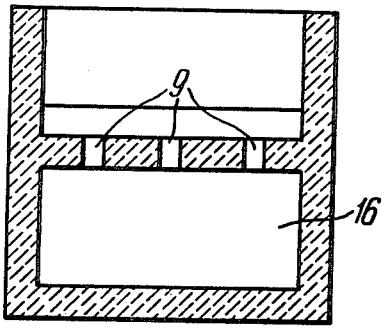
FIG. 2 is a cross sectional view taken along the line II—II of FIG. 1.

Simultaneously with pouring molten metal from the casting ladle 19 into the tundish 1, a flow of inert gas is delivered from a source (not shown) into the chamber 16 from which it is admitted into the zone 13 of the tundish 1 through the orifices 9 (See FIG. 2.).

Metal can be blown through with any inert or neutral gas as, for example, argon or nitrogen, its pressure being maintained above the ferrostatic pressure of the layer of metal which is blown through. To assure that the pressure of gas in the zone 13 of blowing through is constant, the pressure in the chamber 16 must be kept at a prescribed level.

Though the gas is blown through the flow of molten metal from below where the depth is at its minimum, alternatively the flow can be blown through from the side. The only point to be noted is that the orifices through which the metal is blown with the gas are disposed above the upper generatrix of the outlet opening 3 from the tundish 1 by about 300 mm. In the zone 13 of blowing through, the degassing of metal takes place and nonmetallic particles rise to the surface. The degassed metal enters the zone 14 from which it is fed directly into the mold 7. In the zone 14, all the air bubbles, gas and nonmetallic particles still present in the metal rise to the surface whereas refined metal flows through the outlet opening 3 and the conduit 15 into the mold 7 in the interior 6 of which the ingot 17 is formed and withdrawn therefrom by the withdrawal rolls 18 as solidification thereof continues.

The herein described process and apparatus according to the invention improve the quality of the ingot 17.

What is claimed is:

1. A process for horizontal continuous metal casting, comprising the steps of supplying molten metal in a stepped flow through a tundish; blowing through said metal flow a gas which will not react with said metal; and feeding the metal into a horizontally disposed mold; wherein said gas is blown through said metal at a position in said tundish which is above an exit of said tundish where said metal flows into said mold, and said position of the tundish wherein the molten metal flow is being blown through with the gas is substantially isolated from portions of said tundish into which said metal is being fed and from which said metal flows into said mold.

2. A process as claimed in claim 1, wherein the gas is blown through the flow of molten metal from below said flow.

3. The process according the claim 1 wherein the position in said tundish where said gas is blown through said metal is about 300 mm above the position in said tundish where said metal exits said tundish and goes into said mold.

4. An apparatus for horizontal continuous casting of metal, comprising: a tundish with a bottom and side walls, one of said side walls having an outlet opening to place in communication an interior of the tundish with an inlet opening of a mold, said bottom of said tundish being stepped relative to the outlet opening of said tundish, a portion of said tundish being provided with at least one orifice for blowing gas through a flow of molten metal, said orifice being arranged above the level of the upper generatrix of the outlet opening of said tundish, said tundish including a first vertical transverse partition extending short of said step of said tundish to a depth where turbulence is smoothed down, said first partition separating a portion of said tundish into which metal is fed from the portion of said tundish in which said gas is blown through the metal, and said tundish including a second vertical transverse partition extending short of said step of the tundish to a depth where turbulence is smoothed down, said second partition separating the portion of said tundish in which said gas is blown through said metal from portion of said tundish from which said metal is fed into said mold.

5. An apparatus as claimed in claim 1 wherein said at least one orifice for blowing the gas through the flow of molten metal is provided in the step of said bottom of said tundish.

6. An apparatus as claimed in claim 4, wherein said orifice is arranged about 300 mm above the level of the upper generatrix of the outlet opening of said tundish.

* * * * *

UNITED STATES PATENT AND TRADEMARK OFFICE

CERTIFICATE OF CORRECTION

PATENT NO. : 4,186,791
DATED : December 27, 1976
INVENTOR(S) : Vladimir Timofeevich Sladkoshteev, et al It is certified that error appears in the above—identified patent and that said Letters Patent is hereby corrected as shown below:

On the title page, Assignees should read:

--Ukrainsky Nauchno-Issledovatelsky Institut Metallov, and Nauchno-Proizvodstvennoe Obiedinenie "Tulachermet" --.

Signed and Sealed this

*Eighth* Day of *June 1982*

[SEAL]

*Attest:*

GERALD J. MOSSINGHOFF

*Attesting Officer*

*Commissioner of Patents and Trademarks*